US009850727B2

(12) United States Patent
Murphy

(10) Patent No.: US 9,850,727 B2
(45) Date of Patent: Dec. 26, 2017

(54) DOWNHOLE SERVICE TOOL EMPLOYING A TOOL BODY WITH A LATCHING PROFILE AND A SHIFTING KEY WITH MULTIPLE PROFILES

(71) Applicant: Halliburton Energy Services, Inc., Houston, TX (US)

(72) Inventor: Thomas Murphy, Westhill (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/033,436

(22) PCT Filed: Jul. 2, 2015

(86) PCT No.: PCT/US2015/039116
§ 371 (c)(1),
(2) Date: Apr. 29, 2016

(87) PCT Pub. No.: WO2017/003489
PCT Pub. Date: Jan. 5, 2017

(65) Prior Publication Data

US 2017/0175469 A1 Jun. 22, 2017

(51) Int. Cl.
*E21B 23/02* (2006.01)
*E21B 23/04* (2006.01)
*E21B 23/03* (2006.01)

(52) U.S. Cl.
CPC ..... *E21B 23/02* (2013.01); *E21B 23/03* (2013.01); *E21B 23/04* (2013.01)

(58) Field of Classification Search
CPC ..... E21B 23/02; E21B 23/03; E21B 23/04
See application file for complete search history.

(56) References Cited

U.S. PATENT DOCUMENTS

| | | | |
|---|---|---|---|
| 3,863,961 | A | 2/1975 | Dinning |
| 4,002,203 | A | 1/1977 | Terral |
| 5,183,114 | A | 2/1993 | Mashawm, Jr. et al. |
| 5,211,241 | A | 5/1993 | Mashawm, Jr. et al. |
| 5,305,833 | A | 4/1994 | Collins |

(Continued)

OTHER PUBLICATIONS

"PCT Application as Filed", dated Jul. 2, 2015, Appl No. PCT/US2015/039116, "Downhole Service Tool Employing a Tool Body with a Latching Profile and a Shifting Key with Multiple Profiles," filed Jul. 2, 2015, 17 pgs.

(Continued)

*Primary Examiner* — Nicole Coy
(74) *Attorney, Agent, or Firm* — Scott Richardson; Tumey L.L.P.

(57) ABSTRACT

A method for adjusting position of a downhole flow control device, comprising deploying a service tool downhole, wherein the tool includes a tool body with a first latching profile and a shifting key with a second latching profile and travel profile, locking the service tool to a latch interface, and moving part of the service tool to adjust position of the flow control device while the service tool is locked to the latch interface. A system comprising a downhole flow control device, a latch interface, and a service tool, wherein the service tool includes a tool body with a first latching profile, a shifting key with a second latching profile and travel profile, and an actuator to extend and retract the profiles relative to the tool body, wherein position of the flow control device is adjusted by moving the service tool.

18 Claims, 5 Drawing Sheets

(56) References Cited

U.S. PATENT DOCUMENTS

| | | | |
|---|---|---|---|
| 5,309,988 | A | 5/1994 | Shy et al. |
| 5,549,161 | A | 8/1996 | Gomez et al. |
| 5,641,023 | A | 6/1997 | Ross et al. |
| 7,712,538 | B2 | 5/2010 | Fay |
| 8,474,542 | B2 | 7/2013 | Blanton et al. |
| 8,567,501 | B2 | 10/2013 | Zimmerman et al. |
| 2005/0072577 | A1 | 4/2005 | Freeman |
| 2005/0241858 | A1 | 11/2005 | Eppink et al. |
| 2013/0092398 | A1 | 4/2013 | McCoy et al. |
| 2014/0174761 | A1 | 6/2014 | Spencer et al. |

OTHER PUBLICATIONS

"PCT International Search Report and Written Opinion", dated Feb. 5, 2016, Appl No. PCT/US2015/039116, "Downhole Service Tool Employing a Tool Body with a Latching Profile and a Shifting Key with Multiple Profiles," filed Jul. 2, 2015, 10 pgs.

DOWNHOLE SERVICE TOOL EMPLOYING A TOOL BODY WITH A LATCHING PROFILE AND A SHIFTING KEY WITH MULTIPLE PROFILES

BACKGROUND

In the oil and gas industry, downhole flow control devices are often employed. Such flow control devices may be adjusted remotely (e.g., using electric or hydraulic power that extends from earth's surface) or locally (e.g., using a service tool). Local adjustment of a flow control device is not a trivial matter due to issues such as remote service tool alignment with a latch interface of a downhole flow control device, latch strength, and latch durability. Previous efforts to locally adjust a downhole flow control device involves a service tool with radial keys that can extend beyond the tool body (to latch) and that can retract into the tool body (to unlatch). The latch strength and latch durability of existing service tools has been found to be deficient, resulting in wasted time and increased costs related to adjusting downhole flow control devices.

BRIEF DESCRIPTION OF THE DRAWINGS

Accordingly, there are disclosed in the drawings and the following description a downhole service tool employing a tool body with a latching profile and a shifting key with multiple profiles. In the drawings.

Figure 1:
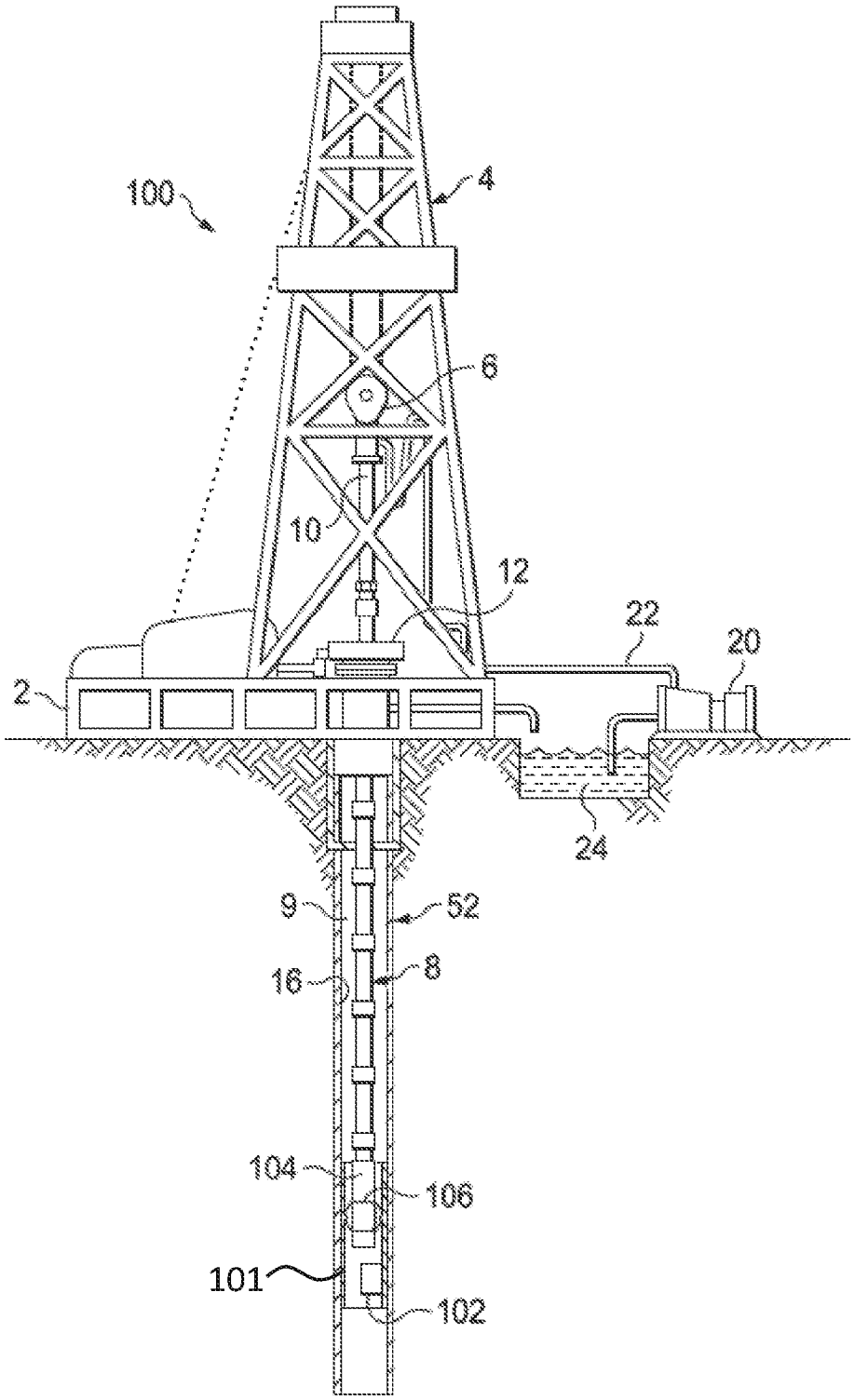
FIG. 1 is a schematic diagram showing an illustrative downhole environment.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein is a service tool that employs a tool body with a latching profile and a shifting key with multiple profiles. For example, one of the multiple profiles of the shifting key may correspond to a latching profile that can extend beyond the tool body to supplement the latching profile of the tool body. As an example, the latching profile of the tool body and the latching profile of the shifting key may be on opposing sides of the service tool to enable the service tool to latch at multiple points to a downhole flow control device or a related latch interface. Another profile of the shifting key may correspond to a travel profile that can extend beyond the tool body to block at least part of the latching profile of the tool body. While other positions are possible, the shifting key may have a "travel" position and a "latching" position.

In the travel position, the shifting key's travel profile is extended beyond the tool body and blocks at least part of the latching profile of the tool body. Meanwhile, in the travel position, the shifting key's latching profile is retracted into the tool body. The travel position is used, for example, to allow the service tool to freely travel up and down a cased borehole to a target position related to adjusting position of a downhole flow control device. Note: multiple flow control device and target positions are possible. Once a target position is reached, an operator can direct the shifting key to move from the travel position to the latching position to lock the service tool to a latch interface associated with a downhole flow control device. Once locked to the flow control device, axial movement of at least part of the service tool can adjust position of the flow control device as desired to increase or decrease flow through the flow control device.

In at least some embodiments, an example method for adjusting the position of a flow control device downhole includes employing a service tool downhole, wherein the service tool includes a tool body with a first latching profile and a shifting key with a second latching profile and a travel profile. The method also includes locking the service tool to a latch interface associated with the flow control device, wherein locking the service tool to the latch interface involves extending the second latching profile of the shifting key beyond the tool body. The method also includes moving at least part of the service tool to adjust position of the flow control device while the service tool is locked to the latch interface.

In at least some embodiments, an example system includes a downhole flow control device and a latch interface associated with the flow control device. The system also includes a service tool having a tool body with a first latching profile and having a shifting key with a second latching profile and with a travel profile. The service tool also includes an actuator to extend and retract the second latching profile and the travel profile of the shifting key relative to the tool body. For example, the actuator may operate to extend the second latching profile beyond the tool body to lock the service tool to the latch interface associated with the flow control device. The position of the flow control device is adjusted by moving at least part of the service tool while the service tool is locked to the latch interface. Various service tool options, shifting key options, and flow control device options are described herein.

The disclosed methods and systems are best understood when described in an illustrative usage context. FIG. 1 shows an illustrative downhole environment 100. In FIG. 1, a wellbore 16 is represented as having been drilled and a casing 52 installed. To drill the wellbore 16, a drilling platform 2 supports a derrick 4 having a traveling block 6 for raising and lowering a tubular string assembly 8. A kelly 10 supports the rest of the tubular string assembly 8 as it is lowered through a rotary table 12. The rotary table 12 rotates the tubular string assembly 8, thereby turning a drill bit (not shown). Additionally or alternatively, rotation of a drill bit is controlled using a mud motor or other rotation mechanism (not shown). During drilling operations, a pump 20 circulates drilling fluid through a feed pipe 22 to the kelly 10, downhole through the interior of tubular string assembly 8, through orifices in the drill bit, back to the surface via an annulus 9 around the tubular string assembly 8, and into a retention pit 24. The drilling fluid transports cuttings from the wellbore 16 into the retention pit 24 and aids in maintaining the integrity of the wellbore 16.

To install the casing 52, modular casing segments are joined and lowered into the wellbore 16 until a desired casing section length is reached. Once a desired length and position for a particular casing section is achieved, cementing operations are performed, resulting in a permanent casing section installation. As needed, the wellbore 16 is extended by drilling through cured cement at an installed casing section terminus. The process of installing casing sections, cementing the installed casing sections in place, and extending wellbore 16 can be repeated as desired.

In FIG. 1, a downhole tool 101 is shown in a casing 52 downhole. In some embodiments, the downhole tool 101 may be permanently installed as one segment of a casing 52 or may be deployed inside of a casing 52. One such downhole tool 101 shown is a flow control device 102, along with a service tool 104, where the operation of the service tool 104 is to adjust a position of the flow control device 102 (to increase or decrease flow through the flow control device 102). The flow control device 102 may be part of the casing 52 (e.g., a customized casing segment) or may be part of an assembly deployed along the casing 52 (e.g., a sand control or intelligent completion assembly). In different embodiments, the flow control device 102 may be part of a sand control tool, a gravel pack tool, a valve assembly, or any other downhole tool that can be deployed downhole. As described in further detail later, at least some embodiments of the service tool 104 include a tool body with a latching profile and a shifting key 106 with multiple profiles.

Figure 2:
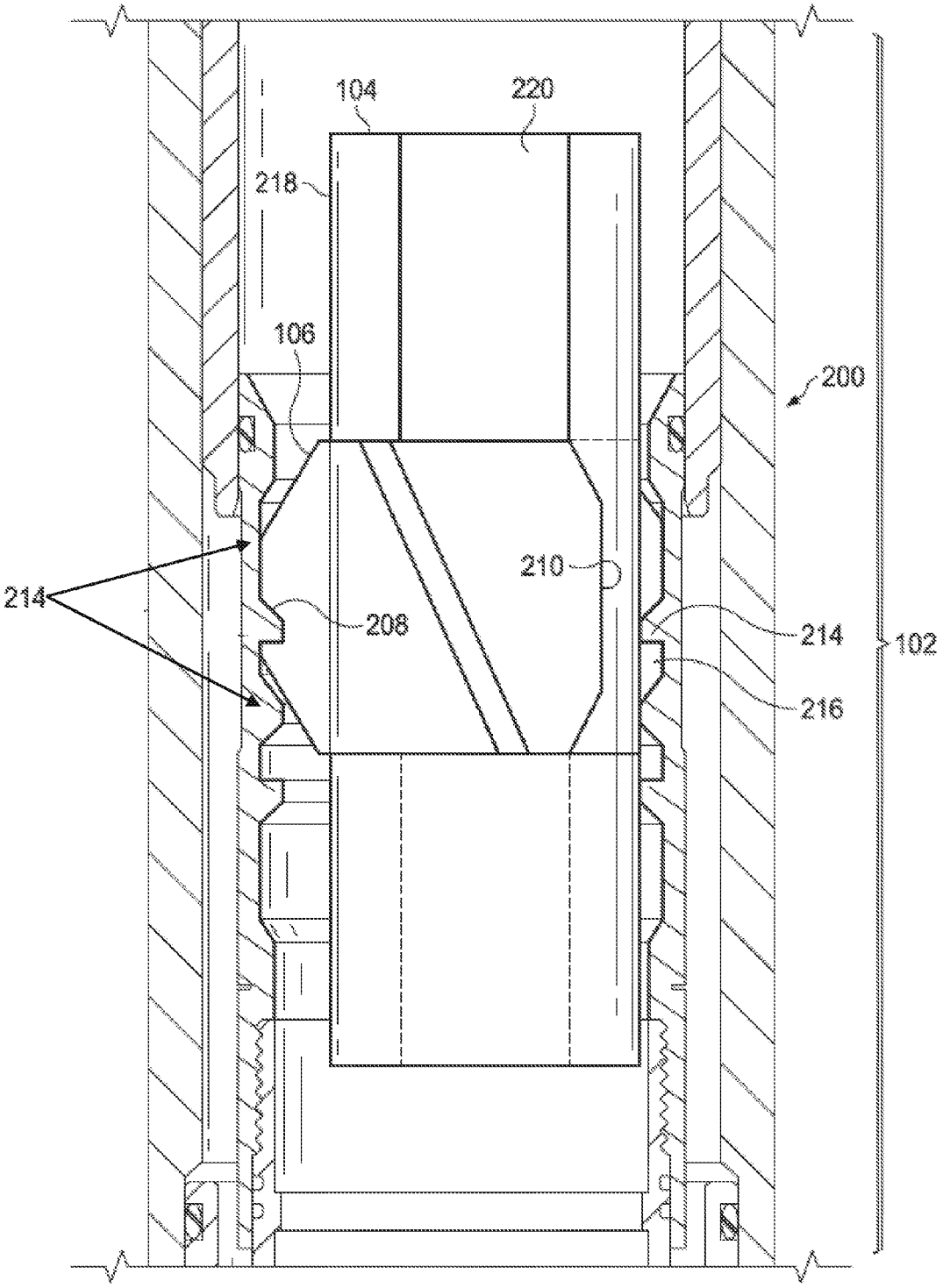
FIG. 2 is a cross-sectional view showing an illustrative service tool latched to an illustrative flow control device.

FIG. 2 is a cross-sectional view showing an illustrative service tool 104 latched to an illustrative flow control device 102 in a downhole environment 200. The service tool 104 may be part of a tubular string assembly 8 (of FIG. 1) which may be moved upwards and downwards to position the service tool 104 at a target position relative to the flow control device 102. When latched, elements of the flow control device 102 can be moved when the service tool 104 is moved (e.g., to increase or decrease flow through the flow control device 102). As shown in FIG. 2, the service tool 104 includes a tool body 218 having a first latching profile 216. The service tool 104 also includes a shifting key 106 with a second latching profile 208 and a travel profile 210. The service tool also includes a linear actuator 220, where axial or linear motion of the linear actuator 220 is converted into radial motion of the shifting key 106. In operation, the actuator 220 can move the shifting key 106 between a travel position and a latching position corresponding to retracting or extending the shifting key 106. In the travel position, the second latching profile 208 of the shifting key 106 is inside the surface of the tool body 218 and thus unable to engage a latch interface 214 associated with the flow control device 102. Also, with the shifting key 106 in the travel position, the travel profile 210 is extended beyond the tool body 218 in a radial direction and acts as a mechanical guard to prevent or block the first latching profile 216 of the tool body 218 from latching to the latch interface 214 associated with the flow control device 102. Alternatively, when the actuator 220 causes the shifting key 106 to move to the latching position, the first and second latching profiles 216, 208 can latch to the latch interface 214 associated with the flow control device 102. At least some embodiments, the shifting key 106 corresponds to a monolithic material (a one-piece component) so that the first latching profile 216 and the travel profile 210 move in concert with one another relative to the tool body 218. For example, when the shifting key 106 moves radially to the latching position, the second latching profile 208 moves outward radially while the travel profile 210 moves inward radially at the same time. In this manner, the shifting key 106 enables both the second latching profile 208 and the travel profiles 210 to move simultaneously to enable the service tool 104 to latch onto the latch interface 214 associated with the flow control device 102. Likewise, when the shifting key 106 is moved to the travel position, a single movement of the shifting key 106 both withdraws the second latch position 208 from engaging the latch interface 214 and extends the travel profile 210 beyond the tool body 106 to prevent or block the first latching profile 216 from engaging the latch interface 214.

In different embodiments, the actuator 220 that moves the shifting key 106 is powered by electrical or hydraulic power originating from earth's surface or from a local power source on or near the service tool 104. For example, in one embodiment, the service tool 104 receives electrical power from a wired tubular string assembly 8 (in FIG. 1) or local battery, where the electrical power runs a hydraulic piston or pump associated with the actuator 220. Operation of the piston causes a linear motion that is used to manipulate the radial position of the shifting key 106 as needed. In another embodiment, the service tool 104 receives electrical power from a wired tubular string assembly 8 (in FIG. 1) or local battery, where the electrical power runs an electrical motor associated with the actuator 220. The electric motor causes a linear motion that is used to manipulate a radial position of the shifting key 106 as needed. Other embodiments are possible and are not limited to these examples.

Figure 3A:
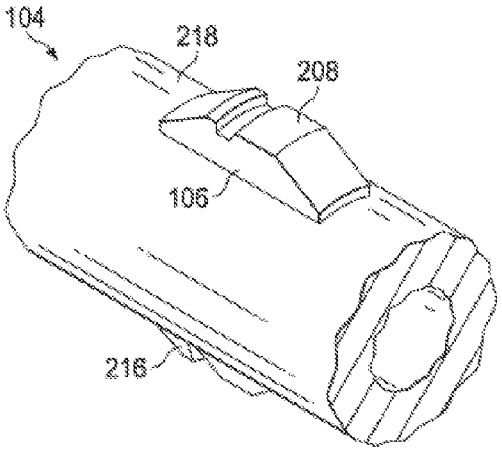
FIGS. 3A, 3B, 3C, and 3D are external views showing an illustrative service tool.
Figure 3B:
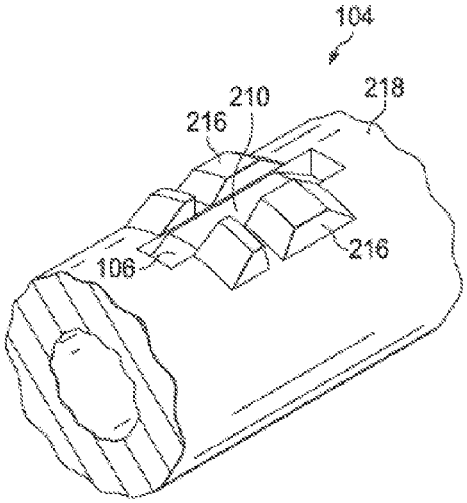
Figure 3C:
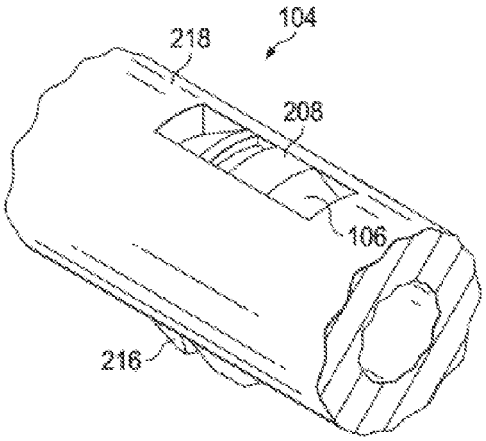
Figure 3D:
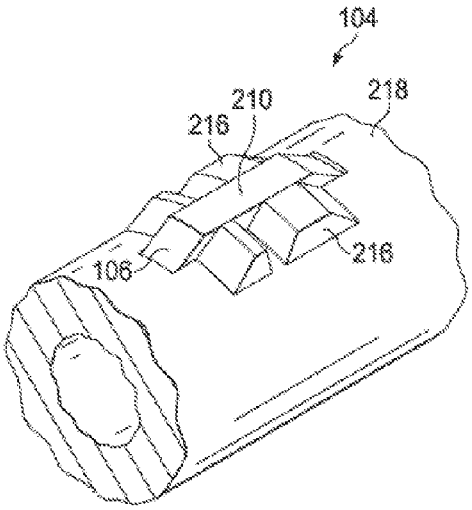

FIGS. 3A, 3B, 3C, and 3D show external views of a service tool 104 having a tool body 218 with a first latching profile 216 and having a shifting key 106 as described herein. In FIG. 3A, the shifting key 106 is represented in a latching position, where the second latching profile 208 can be seen extending from the tool body 218. In FIG. 3B, the shifting key 106 is represented in the latching position as viewed from a different angle relative to FIG. 3A, where the travel profile 210 of the shifting key 106 can be seen retracted within the tool body 218. In FIG. 3C, the shifting key 106 is represented in a travel position, where the second latching profile 208 of the shifting key 106 can be seen retracted within the tool body 218. In FIG. 3D, the shifting key 106 is represented in a travel position at a different angle relative to FIG. 3C, where the travel profile 210 of the shifting key 106 can be seen extending from the tool body 218 and blocking part of the latching profile 216 of the tool body 218.

Figure 4A:
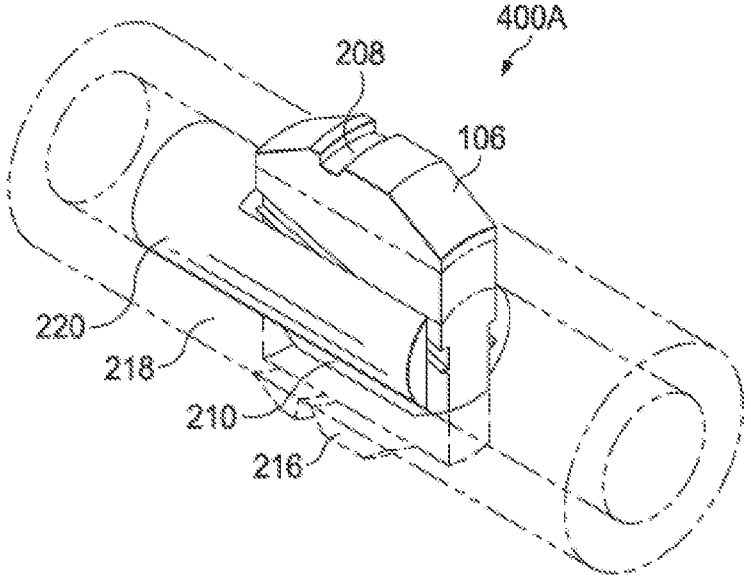
FIGS. 4A and 4B are see-through views showing an illustrative service tool.
Figure 4B:
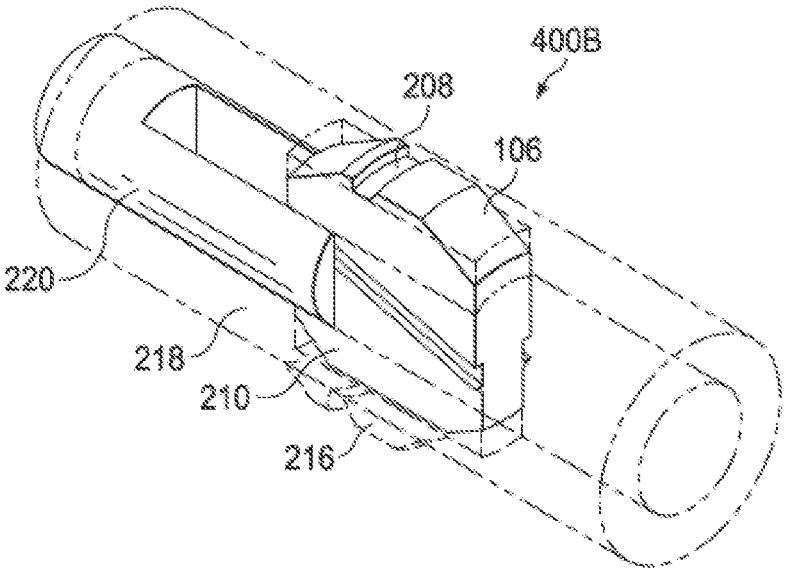

Looking at FIGS. 4A and 4B, these are views showing an illustrative tool body, shifting key 106, and actuators in latching and travel positions 400A, 400B. FIG. 4A shows the tool body 218, the shifting key 106 in a latching position, the first latching profile 216 and the second latching profile 208, and the actuator 220 used to move the shifting key 106 into either the latching or travel positions. With the actuator 220 moved towards the shifting key 106, an internal cam surface (not shown) pushes the shifting key 106 outward radially relative to the tool body 218 and exposes both the first and second latching profiles 216, 208 to allow latching to the latching profile of the flow control device (not shown). When the actuator 220 moves in a direction away from the shifting key 106 as seen in FIG. 4B, the shifting key 106 moves via the camming action to a travel position. In said travel position, the shifting key travel profile 210 moves outward from the tool body 218 surface and serves to prevent or block the first latching profile 216 of the tool body 218 from latching. Correspondingly, when the shifting key 106 moves to the travel position, the second latching profile 208 withdrawals into the tool body 218 and thus cannot latch to a corresponding profile.

Figure 5:
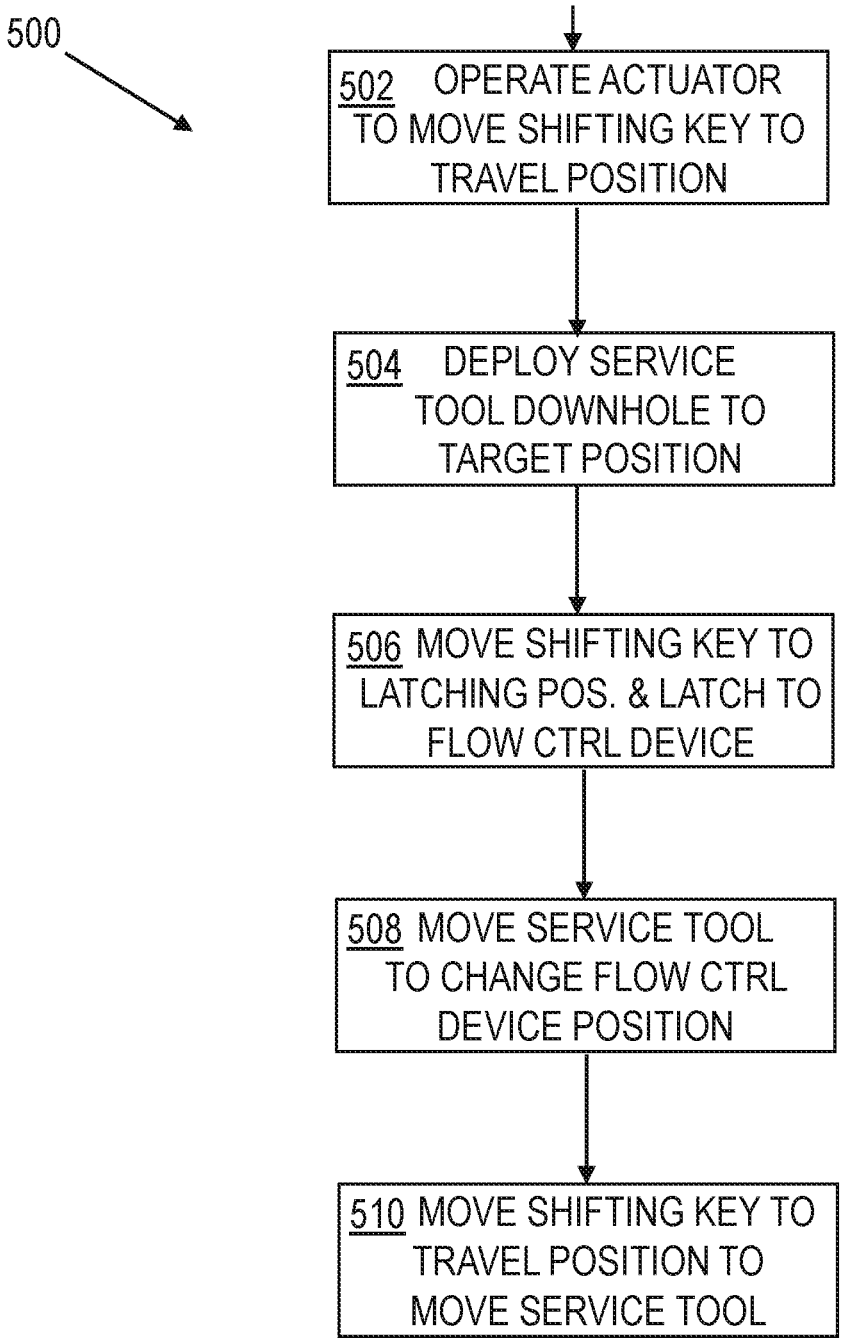
FIG. 5 is a flow chart showing an illustrative downhole flow control device adjustment method.

FIG. 5 presents an illustrative process 500 for adjusting the position of a flow control device in a downhole environment. As described herein, the process may be used for controlling the position of a flow control device or for other downhole tools such as sand control devices or downhole fluid valves. In block 502, and prior to contact with any downhole tools employing a latching interface, the surface operator moves the actuator to place the shifting key into a travel position. In this position, the second latching profile of the shifting key is withdrawn into the tool body while the travel profile extends outward, thus preventing or blocking the first latching profile of the tool body from mechanically engaging any corresponding latching profiles of downhole tools. By being in the travel position, the shifting key and thus the service tool will pass through the interior space of any downhole tools without mechanically latching to them, thus allowing travel to the desired region of the borehole. In block 504, the service tool is sent down a cased or uncased borehole as part of a tubular string assembly to a target position in relation to a flow control device. In block 506, the surface operator moves the actuator to place the shifting key into a "latching" position. By actuating the shifting key to a "latching" position, the operator places the second latching profile to extend past the outer circumference of the tool body and retracts the travel profile from the first latching profile of the tool body, thus enabling the first latching profile of the tool body to contact with, and mechanically connect to, a downhole flow control device employing a corresponding latching profile. The operator then moves the tubular string assembly and associated service tool to make contact with, and mechanically connect to, the latching profile of the downhole flow control device. Once mechanically connected, the service tool and the flow control device will stay mechanically connected until the actuator inside the tool body moves the shifting key back to the travel position. In block 508, the surface operator can change the position of a flow control device by moving the service tool upwards or downwards. This is done by moving the tubular string assembly upwards or downwards. Since the service tool is mechanically latched to the flow control device, the position of elements within the flow control device can be adjusted as needed to, for example, turn on or off a valve or open or close a screen. In block 510, once adjustments to the flow control device are completed, the operator may move the shifting key from the latching position to the travel position and move the service tool and associated tubular string assembly to another target position.

Embodiments disclosed herein include:

A: a method for adjusting position of a downhole flow control device, the method comprising deploying a service tool downhole, wherein the service tool includes a tool body with a first latching profile and a shifting key with a second latching profile and with a travel profile, locking the service tool to a latch interface associated with the flow control device, wherein said locking comprises extending the second latching profile beyond the tool body, and moving at least part of the service tool to adjust position of the flow control device while the service tool is locked to the latch interface.

B: a system, comprising a downhole flow control device, a latch interface associated with the flow control device; and a service tool, wherein the service tool includes a tool body with a first latching profile, a shifting key with a second latching profile and with a travel profile, and an actuator to extend and retract the second latching profile and the travel profile relative to the tool body, wherein the actuator operates to extend the second latching profile beyond the tool body to lock the service tool to the latch interface, and wherein position of the flow control device is adjusted by moving at least part of the service tool while the service tool is locked to the latch interface.

Each of embodiments A and B may have one or more of the following additional elements in any combination: Element 1: wherein said locking further comprises retracting the travel profile into the tool body. Element 2: further comprising moving the service tool to a target position along a casing string to align the shifting key with the latch interface, wherein said moving the service tool along the casing string to the target position is performed at least in part while the travel profile extends beyond the tool body and blocks at least part of the first latching profile. Element 3: further comprising moving the service tool to a target position along a casing string to align the shifting key with the latch interface, wherein said moving the service tool along the casing string to the target position is performed at least in part while the second latching profile is retracted within the tool body. Element 4: further comprising unlocking the service tool from the latch interface, wherein said unlocking comprises retracting the second latching profile within the tool body. Element 5: wherein said unlocking comprises extending the travel profile beyond the tool body to block at least part of the first latching profile. Element 6: wherein the shifting key is a one-piece component with opposing sides corresponding to the second latching profile and the travel profile. Element 7: wherein said locking comprises applying hydraulic power to extend the second latching profile and to retract the travel profile. Element 8: wherein said locking comprises applying electrical power to extend the second latching profile and to retract the travel profile. Element 9: wherein said locking involves converting axial movement of a linear actuator to radial movement of the shifting key. Element 10: wherein the actuator operates to retract the travel profile into the tool body to unblock the first latching profile and to lock the service tool to the latch interface using the first latching profile. Element 11: wherein the shifting key is set with the travel profile extended beyond the tool body to block at least part of the first latching profile while the service tool moves along a casing string to a target position that aligns the shifting key with the latch interface. Element 12: wherein the shifting key is set with the second latching profile retracted within the tool body while the service tool moves along a casing string to a target position that aligns the shifting key with the latch interface. Element 13: wherein the actuator operates to retract the second latching profile into the tool body to unlock the service tool from the latch interface. Element 14: wherein the actuator operates to extend the travel profile beyond the tool body to unlock the service tool from the latch interface and to block at least part of the first latching profile. Element 15: wherein the shifting key comprises a one-piece component with opposing sides corresponding to the second latching profile and the travel profile. Element 16: wherein the actuator comprises an electro-mechanical actuator. Element 17: wherein the actuator comprises an electro-hydraulic actuator. Element 18: further comprising an interface between the actuator and the shifting key to convert linear movement of the actuator into radial movement of the shifting key.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

What is claimed is:

1. A method for adjusting position of a downhole flow control device, the method comprising:

deploying a service tool downhole, wherein the service tool includes:

a tool body with a first latching profile; and a shifting key with a second latching profile and with a travel profile;

locking the service tool to a latch interface associated with the flow control device, wherein said locking comprises extending the second latching profile beyond the tool body and retracting the travel profile into the tool body; and moving at least part of the service tool to adjust position of the flow control device while the service tool is locked to the latch interface.

2. The method of claim 1, further comprising moving the service tool to a target position along a casing string to align the shifting key with the latch interface, wherein said moving the service tool along the casing string to the target position is performed at least in part while the travel profile extends beyond the tool body and blocks at least part of the first latching profile.

3. The method of claim 1, further comprising moving the service tool to a target position along a casing string to align the shifting key with the latch interface, wherein said moving the service tool along the casing string to the target position is performed at least in part while the second latching profile is retracted within the tool body.

4. The method of claim 1, further comprising unlocking the service tool from the latch interface, wherein said unlocking comprises retracting the second latching profile within the tool body.

5. The method of claim 4, wherein said unlocking comprises extending the travel profile beyond the tool body to block at least part of the first latching profile.

6. The method of claim 1, wherein the shifting key is a one-piece component with opposing sides corresponding to the second latching profile and the travel profile.

7. The method of claim 1, wherein said locking comprises applying hydraulic power to extend the second latching profile and to retract the travel profile.

8. The method of claim 1, wherein said locking comprises applying electrical power to extend the second latching profile and to retract the travel profile.

9. The method of claim 1, wherein said locking involves converting axial movement of a linear actuator to radial movement of the shifting key.

10. A system, comprising:

a downhole flow control device;

a latch interface associated with the flow control device; and a service tool, wherein the service tool includes:

a tool body with a first latching profile;

a shifting key with a second latching profile and with a travel profile; and an actuator to extend and retract the second latching profile, and the travel profile relative to the tool body, wherein the actuator operates to extend the second latching profile beyond the tool body to lock the service tool to the latch interface, to retract the travel profile into the tool body to unblock the first latching profile, and to lock the service tool to the latch interface using the first latching profile, and wherein position of the flow control device is adjusted by moving at least part of the service tool while the service tool is locked to the latch interface.

11. The system of claim 10, wherein the shifting key is set with the travel profile extended beyond the tool body to block at least part of the first latching profile while the service tool moves along a casing string to a target position that aligns the shifting key with the latch interface.

12. The system of claim 10, wherein the shifting key is set with the second latching profile retracted within the tool body while the service tool moves along a casing string to a target position that aligns the shifting key with the latch interface.

13. The system of claim 10, wherein the actuator operates to retract the second latching profile into the tool body to unlock the service tool from the latch interface.

14. The system of claim 10, wherein the actuator operates to extend the travel profile beyond the tool body to unlock the service tool from the latch interface and to block at least part of the first latching profile.

15. The system of claim 10, wherein the shifting key comprises a one-piece component with opposing sides corresponding to the second latching profile and the travel profile.

16. The system of claim 10, wherein the actuator comprises an electro-mechanical actuator.

17. The system of claim 10, wherein the actuator comprises an electro-hydraulic actuator.

18. The system of claim 10, further comprising an interface between the actuator and the shifting key to convert linear movement of the actuator into radial movement of the shifting key.

* * * * *